US011946729B2

(12) United States Patent
Burke

(10) Patent No.: US 11,946,729 B2
(45) Date of Patent: Apr. 2, 2024

(54) BULLET CONFIGURED TO MONITOR, TRACK AND FACILITATE INITIAL CARE OF A GUNSHOT VICTIM OF THE BULLET

(71) Applicant: Diallo Staniko Burke, College park, GA (US)

(72) Inventor: Diallo Staniko Burke, College park, GA (US)

( * ) Notice: Subject to any disclaimer, the term of this patent is extended or adjusted under 35 U.S.C. 154(b) by 0 days.

(21) Appl. No.: 17/931,692

(22) Filed: Sep. 13, 2022

(65) Prior Publication Data

US 2023/0081028 A1 Mar. 16, 2023

Related U.S. Application Data

(60) Provisional application No. 63/245,048, filed on Sep. 16, 2021.

(51) Int. Cl.
*F42B 30/02* (2006.01)
*F42B 12/36* (2006.01)

(52) U.S. Cl.
CPC ..... *F42B 30/02* (2013.01); *F42B 12/365* (2013.01)

(58) Field of Classification Search
None
See application file for complete search history.

(56) References Cited

U.S. PATENT DOCUMENTS 3,893,866 A * 7/1975 Hollingsworth ..... F42B 12/54 102/512
7,163,515 B2 * 1/2007 McNenny ..... A61B 5/150022 606/167
8,087,335 B2 * 1/2012 Shekarri ..... F41H 13/0031 119/908
8,167,234 B1 * 5/2012 Moore ..... B64C 37/00 244/17.23
9,638,501 B2 * 5/2017 Parker ..... F42B 12/365
9,784,542 B1 * 10/2017 McMillan ..... F42B 12/40
10,401,136 B1 * 9/2019 VanTassell ..... G01S 19/35
10,495,429 B2 * 12/2019 Omonira ..... F42B 12/54
10,718,750 B1 * 7/2020 McDaniel ..... B64G 99/00
10,900,754 B1 * 1/2021 Basche ..... F41G 9/00
2004/0133126 A1 * 7/2004 McNenny ..... A61B 5/150923 600/573
2009/0020002 A1 * 1/2009 Williams ..... F41H 13/0031 89/41.03
2014/0018769 A1 * 1/2014 Alnafisah ..... A61D 7/00 604/130
2015/0181945 A1 * 7/2015 Tremblay ..... A24F 40/60 131/328
2015/0268017 A1 * 9/2015 Diemer ..... F42B 7/02 102/439
2016/0298947 A1 * 10/2016 Rubin ..... F42B 12/54
2016/0356582 A1 * 12/2016 Beckman ..... A61B 10/0045
2017/0102206 A1 * 4/2017 Ngeyi ..... F41B 7/003
2020/0109928 A1 * 4/2020 Omonira ..... A61K 33/06
2021/0063129 A1 * 3/2021 Parker ..... G01H 1/00
2022/0196366 A1 * 6/2022 Beckman ..... F41G 3/12

OTHER PUBLICATIONS

Rebecca Basu, "By Detecting Genetic Material, Fast Sensor has Potential Use as a Clinical Tool", Mar. 8, 2021, American University (Year: 2021).*

* cited by examiner

*Primary Examiner* — Derrick R Morgan
(74) *Attorney, Agent, or Firm* — Dunlap Bennett & Ludwig, PLLC

(57) ABSTRACT

A smart bullet configured for monitoring, tracking, and facilitating initial care of the gunshot victim of the bullet.

11 Claims, 2 Drawing Sheets

BULLET CONFIGURED TO MONITOR, TRACK AND FACILITATE INITIAL CARE OF A GUNSHOT VICTIM OF THE BULLET

CROSS-REFERENCE TO RELATED APPLICATION

This application claims the benefit of priority of U.S. provisional application No. 63/245,048, filed 16 Sep. 2021, the contents of which are herein incorporated by reference.

BACKGROUND OF THE INVENTION

The present invention relates to firearm safety and, more particularly, a bullet configured for monitoring, tracking, and facilitating initial care of a gunshot victim of the bullet.

Gunshot victims are commonly in urgent need of swift medical assistance, wherein the more information the medical assistance has regarding the gunshot wound in advance of treatment, the more the probability of a positive outcome for the victim. Such advance information includes the location of the bullet as well as the real-time data of the victim's vital signs, whereby the wound site can be quickly identified and treated, and the bullet removed. Gunshot tracking and situational awareness systems usually tell the area of gunfire within a large physical space, but not the location of the victim. These systems also do not indicate where on the victim's body the wound site is specifically located nor data regarding the victim's vital signs and measurements in and around the wound site, such as temperature and other measurements that indicate the state of a patient's essential body functions.

As can be seen, there is a need for a bullet adapted to identify its location data, collect vital sign data, and remotely communicate such data in real time with emergency personnel regarding the gunshot wound it occupies.

Accordingly, the present invention is designed to communicate life saving data for gunshot victims. For instance, the method of the present invention embodies a bullet that uses lasers to help stop victims from bleeding out and communicate to emergency services when hemoglobin is detected. The present invention is intended to extend the life of gunshot victims and provide real-time data on the victim's vitals and the specific location of the bullet, thereby facilitating getting gunshot victims' timely life-extending medical care.

The present invention is intended to track the gunshot victim through providing gunshot identification and location data to emergency personnel. Bullets are normally designed to harm or kill the target. The bullet embodied in the present invention is designed to provide life extending care and to help human victims get the help they need.

In sum, the present invention improves on the basic design of bullets by allowing for the monitoring, tracking, and facilitating initial care of the gunshot victim of the bullets, as well as providing real-time data on the victim's vitals data and the bullet's location to remote emergency personnel.

SUMMARY OF THE INVENTION

In one aspect of the present invention, a bullet dimensioned to be fired from a handgun, the bullet comprising a DNA detector.

In another aspect of the present invention, the bullet includes a bullet casing encasing the DNA detector, wherein protrusions directly connected to the DNA detector protrudes beyond the casing; further including a position locator configured to define its global positioning; and an alert system operatively associated with the DNA detector so that if DNA is detected the alert system communicates a global position of the bullet; a sensor configured to determine a temperature of a substance the bullet casing is embedded in; a cauterizing heating element configured to emit heat when DNA is detected; and a power source encased by the bullet casing.

In another aspect of the present invention, a method of medically assisting a gunshot victim, the method including housing a DNA detector in a bullet causing the gunshot.

In still yet another aspect of the present invention, method of claim 8, further comprising: encasing a position locator in the bullet, wherein the position locator is configured to define its global positioning; and operatively associating an alert system with the DNA detector so that if DNA is detected the alert system communicates a global position of the bullet.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a smart bullet configured for monitoring, tracking, and facilitating initial care of the gunshot victim of the bullet.

Figure 1:
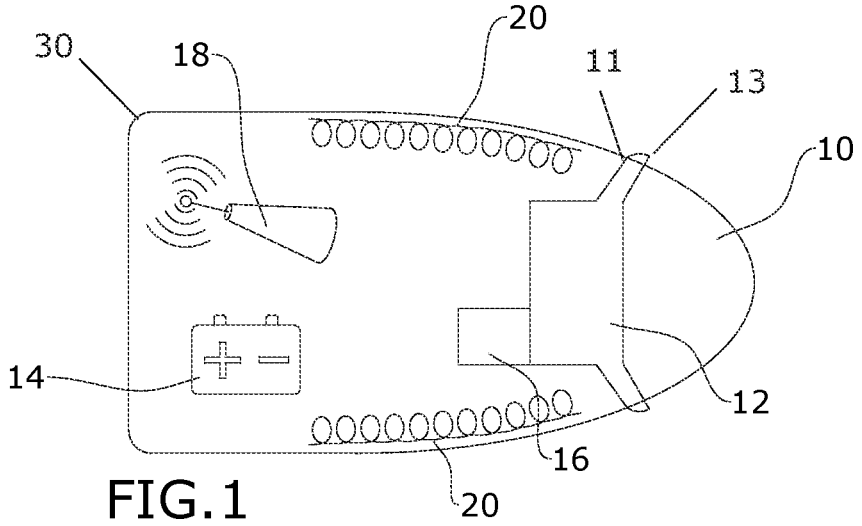
FIG. 1 is a schematic view of an exemplary embodiment of the present invention.
Figure 2:
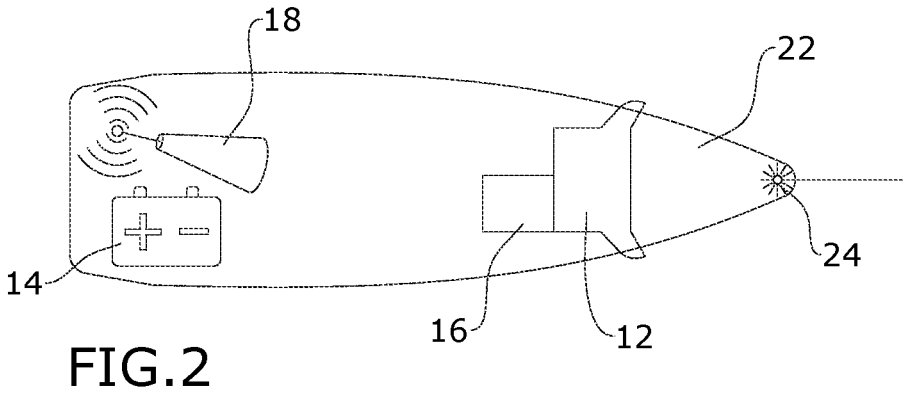
FIG. 2 is a schematic view of an exemplary embodiment of the present invention.
Figure 3:
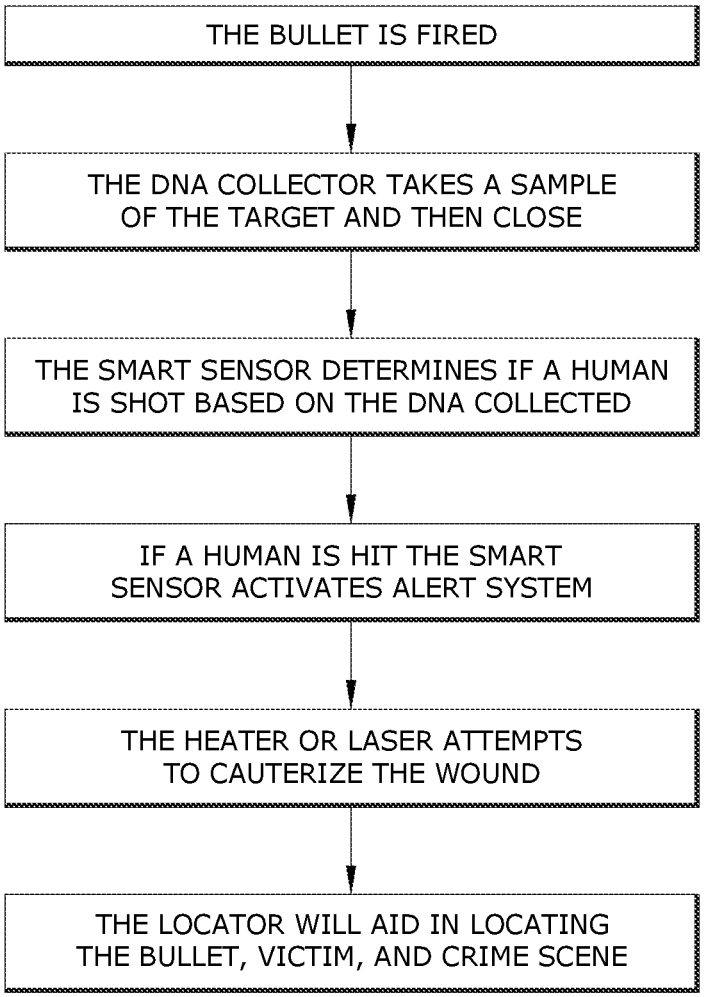
FIG. 3 is a flowchart view of an exemplary embodiment of the present invention.

Referring now to FIGS. 1 through 3, the present invention may include a bullet 10 or 22 comprising a DNA (Deoxyribonucleic acid) collector 12, a power source 14, a smart sensor 16, a positioning locator 18, a cauterizing heater 20 and/or a cauterizing laser 24. The positioning locator 18 may be enabled to provide a satellite-based radionavigation system, a global positioning system or the like for identifying its four-dimensional position in spacetime.

A bullet casing 30 encases the above-mentioned components. The bullet casing 30 is adapted from a material of sufficient strength and impact resistance to shield the above-mentioned components from failure due to the bullet 10 impacting a victim when the bullet is fired from a firearm. The bullet casing 30 may provide apertures 11 through which collectors 13 of the internalized DNA collector 12 may protrude therefrom, whereby the collectors 13 can physically contact the surroundings beyond the bullet casing 30. The DNA collector 12 is dimensioned and adapted to determine if a human victim has been shot. The positioning locator 18 is designed to send notifications to emergency services to locate the bullet 10 and thus the victim, while also providing information on the location of the bullet in victim. The positioning locator 18 may be configured to only activate regarding the smart sensor 16.

The smart sensor 16 is configured to check for the presence of hemoglobin and human DNA specific markers. The smart sensor 16 is configured to work in coordination with the positioning locator 18 in determining where and in which organ the bullet is located after collection from via the apertures 11. The positioning locator 18 is configured to immediately activate when human DNA and proteins are identified, which in turn activates the cauterizing heater 20 to help minimize bleeding. The power source 12 powers the above-mentioned cauterizing heater 20, the positioning locator 18, the smart sensor 16 and the DNA collector 12.

The smart sensor 16 aids in the identification of human DNA and the location of the bullet inside the victim. The positioning locator 18 aids in locating the bullet, victim, and scene of the crime. An alert system may be placed in the bullet which will activate once human DNA is detected. A cauterizing heat source or laser 22 may be placed in bullet 10 to aid in life preservation by cauterizing the wound. Apertures 11 may be placed in the bullet which are designed to collect DNA for use in determining if the victim is human and for DNA collection if the bullet passes through victim. The power source 12 is needed to power the system.

The locator, smart sensor, battery, and alert system are essential in identifying victims and aid in getting timely help to gunshot victims. The holes and thermal heat source are optional but will aid in getting lifesaving help to victims.

The locator and emergency alert system can be used to create a general emergency alert system. This system can be used to track weapons and their firing in sensitive locations such as hospitals, schools, government buildings, etc. The sensor can be tailored to alert authorities to damage to personal and private property by utilizing a smart scanner that identifies these objects. The smart sensor can potentially be tailored to record health data such as blood pressure and vitals which would aid in getting accurate help to victims.

A method of using the present invention may include the following. The smart bullet 10 disclosed above may be provided. The present invention can be used to cut down the response time and help in the identification of mass shootings. The present invention can be used to create an alert system that tells where the crime occurred and in assisting victims in getting timely care.

Additionally, the present invention can be used as a global tracking system for gun owners and ammo.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A bullet dimensioned to be fired from a handgun, the bullet comprising:

a bullet casing; and deoxyribonucleic acid (DNA) detector including a DNA collector and sensor, the DNA detector housed within the bullet casing, wherein the bullet casing is made of material having an impact resistance to prevent failure of the DNA detector upon the bullet by being fired by the handgun into a human.

2. The bullet of claim 1, wherein the bullet casing has a tapered nose portion.

3. The bullet of claim 2, wherein protrusions directly connected to the DNA detector protrude beyond the bullet casing.

4. The bullet of claim 1, further comprising:

a position locator configured to define a global positioning of the bullet; and an alert system operatively associated with the DNA detector so that if DNA is detected the alert system communicates a global position of the bullet.

5. The bullet of claim 4, further comprising a sensor configured to determine a temperature of a substance the bullet casing is embedded in.

6. The bullet of claim 5, further comprising a cauterizing heating element configured to emit heat when DNA is detected.

7. The bullet of claim 6, further comprising a power source encased by the bullet casing.

8. The bullet of claim 1, further comprising at least one aperture through the bullet casing; and at least one protrusion extending from the DNA detector, through the apertures and protruding beyond the bullet casing.

9. The bullet of claim 8, wherein the at least one protrusion is configured to collect DNA.

10. A method of medically assisting a human gunshot victim, the method comprising:

providing a deoxyribonucleic acid (DNA) detector including a DNA collector and sensor, housing the DNA detector in a bullet so that if said bullet entered the human gunshot victim the DNA detector is configured to identify human DNA markers for initiating medical assistance for the human gunshot victim.

11. The method of claim 10, further comprising:

encasing a position locator in the bullet, wherein the position locator is configured to define a global positioning of the bullet; and operatively associating an alert system with the DNA detector so that if DNA is detected the alert system communicates a global position of the bullet.

* * * * *